United States Patent [19]

Polhemus et al.

[11] Patent Number: 4,475,022

[45] Date of Patent: Oct. 2, 1984

[54] DESK ACCESSORY SYSTEM

[75] Inventors: Marlan H. Polhemus, Chicago; Lonnie E. Frye, Arlington Heights, both of Ill.

[73] Assignee: Tenex Corporation, Elk Grove, Ill.

[21] Appl. No.: 318,749

[22] Filed: Nov. 6, 1981

Related U.S. Application Data

[62] Division of Ser. No. 123,680, Feb. 22, 1980, Pat. No. 4,320,835.

[51] Int. Cl.[3] ..... A45C 11/34

[52] U.S. Cl. ..... 206/214; 206/577; 220/23.8; 220/23.86; 220/23.83

[58] Field of Search ..... 206/214, 577, 601, 555; D19/78; 220/23.8, 23.86, 23.83

[56] References Cited

U.S. PATENT DOCUMENTS

| | | | |
|---|---|---|---|
| D. 133,705 | 9/1942 | Ressinger | D19/78 |
| D. 155,124 | 9/1949 | Carver | D19/78 |
| D. 209,882 | 1/1968 | Andersen | D19/78 |
| D. 250,269 | 11/1978 | Spellier | D19/78 |
| D. 260,906 | 9/1981 | Grusing | D19/78 |
| 3,498,494 | 3/1970 | Voorhees, Jr. | 206/501 |
| 3,589,554 | 6/1971 | Smith | 220/23.83 |
| 3,908,852 | 9/1975 | Ricobene et al. | 220/23.6 |
| 3,917,106 | 11/1975 | Bargetzi | 220/23.83 |
| 4,176,743 | 12/1979 | Fitzpatrick | 206/214 |

FOREIGN PATENT DOCUMENTS

| | | | |
|---|---|---|---|
| 709688 | 6/1954 | New Zealand | 206/555 |

*Primary Examiner*—Joseph Man-Fu Moy
*Attorney, Agent, or Firm*—Hosier, Niro & Daleiden

[57] ABSTRACT

This is a multi-purpose, low-profile desk accessory in which a horizontally oriented flat base sheet is formed with upstanding walls which define a plurality of shallow storage wells, including one for the storage for a roll of tape which is horizontally oriented, and another for the storage of a flat stack of unbound note paper. Suitable means are provided for twisting the tape 90° as it comes off the tape roll. Above these shallow storage wells are upper decks which provide additional storage space, some of which is specifically dedicated to such office implements as a ring-bound calendar, and possibly an ash tray or card file. Alongside the shallow lower level and upper level storage facilities is an elevated structure which includes deep wells for the storage of paper clips and similar desk implements, and another deep well for storing elongated writing instruments such as pens and pencils in a horizontal attitude. The latter has a special floor shape which tilts the pens and pencils upwardly so that they can be easily grasped and removed for use.

16 Claims, 15 Drawing Figures

34
32
24
28
30
96
98
52
50
58
56
60
40
110
42
44
54
38
26
108

DESK ACCESSORY SYSTEM

This is an divisional application of application Ser. No. 123,680, filed Feb. 22, 1980 now U.S. Pat. No. 4,320,835.

BACKGROUND OF THE INVENTION

It is desirable for a number of different office implements to be kept within easy reach of an office worker upon a desk top. For example, many office workers like to have at hand a dispenser of tape having pressure-sensitive adhesive on one side. Such tape, which is often of transparent cellophane material, is usually purchased in annular rolls which are wound in spiral fashion. It is conventional for tape rolls of this kind to be mounted in dispensers which have an axial hub about which the tape roll core rotates freely, and a retaining surface to which the free end of the tape adheres. Adjacent the retaining surface there is usually provided a serrated knife edge for severing the tape after a desired length has been pulled off the roll. Conventionally, tape dispensers of this kind store the tape roll in an upright position. Such tape dispensers do not achieve a low profile, because the height of the dispenser above the desk top is generally of the same order of magnitude as the diameter of a full roll of tape.

Other accessories which are commonly found on desk tops include a storage bin for unbound sheets of writing paper arranged in a stack, and other storage bins for such items as pens and pencils, paper clips, rubber bands, and the like. Paper clips are commonly made of steel wire, and so have ferromagnetic properties which lend themselves to the use of a permanent magnet located at the top of a paper clip dispenser, for the purpose of pulling the paper clips up to the mouth of the dispenser.

Pen and pencil holders are conventionally made in the form of an upright cylindrical cup. This configuration has the advantage of making it easy to grasp one of the pens or pencils and remove it from the cup, but again this type of desk accessory does not have a low profile, since the height of the cup is normally over half the length of the pens and pencils stored therein. Many people consider that, for reasons of style and esthetic appeal, desk accessories should have as low a profile as possible.

Another accessory commonly found on desks is a file of the flip-card type, which are generally used to store such information as names, addresses and telephone numbers of customers or other people who are frequently contacted. Another common desk accessory is a daily calendar of the kind which has one or two pages for each day, these pages being bound upon two standing loops of metal which permit the pages to be turned at the beginning of a new day. Many individuals smoke cigars or cigarettes during the working day, and for such people it is essential to have an ash tray close at hand. The presence of all these various forms of desk accessories on the same desk at the same time contributes to clutter, which is considered undesirable both from a visual standpoint and from the standpoint of working efficiency.

SUMMARY OF THE INVENTION

The present invention provides a single-purpose or multi-purpose desk accessory which has a low profile so as to increase the range of styling effects which is available to the designer of desk accessories, and which, in its multipurpose version, combines a large number of different desk accessories into a single structure. Because of the low profile aspect of this device, this multipurpose structure can combine a number of different accessories in a bi-level arrangement, and still retain the low profile appearance which is desirable from a styling point of view.

In accordance with this invention, there is provided low-profile desk-top apparatus for dispensing adhesive tape. The apparatus comprises a substantially planar base which sits in a horizontal attitude upon a desk top, with one surface thereon facing upwardly. A hub on the base projects upwardly from the upper surface thereof, and is oriented with its axis substantially vertical. The hub has an outside diameter somewhat smaller than the inside diameter of the core of a tape roll, so that the roll may be journaled upon the hub in a substantially horizontal orientation, in order to maintain a low profile, and will rotate freely about the hub as tape is pulled off the roll. There is also means including a substantially horizontal tape-retaining surface for retentively engaging an adhesive side of a free end of the tape, and means supporting the tape-retaining surface at some vertical height above the upper surface of the base, and at some radial distance from the outer circumference of the tape roll. The height of the tape-retaining surface above the upper surface of the base is of the same order of magnitude as the breadth of the tape. As a result of the horizontal orientation of the tape roll upon the hub, and the low height of the tape-retaining surface, the tape dispenser maintains a low profile.

In a preferred embodiment of the invention, there is also tape-twisting means including a horizontal tape-twisting surface which faces in a substantially vertical direction opposite to that of the tape-retaining surface, and which is adapted for moveably engaging a non-adhesive side of the tape. The tape-twisting surface is supported at a vertical height above the upper surface of the base which is not greater than the height of the tape-retaining surface. This type of arrangement assures that the tape, which is oriented in a vertical plane as it comes off the horizontally stored roll, can be subsequently twisted one quarter of a turn to assume a horizontal orientation before it meets up with the tape-retaining surface.

To complete the tape dispenser, there is preferably an upper deck which fits removeably over the base and covers over the horizontally oriented tape roll. This upper deck has an exit aperture over the tape-retaining surface, which permits finger access to the free end of the tape so that it may be freed from the retaining surface and pulled through the exit aperture.

The multi-purpose aspect of this invention includes the possibility that the upper surface of the upper deck may be provided with an upwardly facing storage recess. Within that recess various desk implements may be stored, or the recess may serve as a base for mounting a desk accessory such as an ashtray or a card file, or even both of them at different times.

Another multi-purpose aspect of this invention contemplates the provision of a wall on the base which encircles the hub to define a tape well within which the roll of tape is stored when mounted upon the hub. This wall may also extend outwardly from the tape well to encircle another portion of the upper surface of the base, to define a storage well which is horizontally displaced from the tape well. This tape well, for example, may be rectangularly shaped and sized to receive a stack of unbound writing paper sheets oriented horizontally. The upper deck may cover over both the tape well and the paper storage well, and the exit aperture may extend over the tape-retaining surface and also over an edge of the paper storage well, so that either tape or a sheet of writing paper may be withdrawn from the aperture.

There may also be additional storage wells defined on the base by the configuration of the wall, and an additional upper deck to cover over these additional storage wells. The additional upper deck may also have provisions for mounting a desk accessory above it, such as for example a ring-bound calendar.

Finally, the wall may include an elevated structure which is horizontally displaced from the tape well and the storage wells and which rises to the height of the upper deck. Preferably one or more deep wells may be formed in this elevated structure, which are adapted for storage of additional desk implements that require a deeper storage space than the storage wells which are below the decks. For example, one of these deep wells may be designed to accommodate paper clips, and preferably would include a permanent magnet of some sort secured adjacent the top of the well to retain some paper clips at an upper level of the well.

Another possibility is that a deep well may be provided which is horizontally elongated to accommodate one or more elongated writing utensils such as pencils and pens. This has the advantage of providing a low-profile storage space for the pens and pencils. But in order to make it easy to grasp one of the pens and pencils, so as to remove it from the storage well, it is preferred that there be upwardly convex means on the floor of the well so that one end of the pen or pencil will project above the floor. It is also preferred that the apex of this convex means be located at one side of the longitudinal mid-point of the well, so that the user can predict in advance which end of the pen or pencil will project above the floor.

DETAILED DESCRIPTION OF THE PREFERRED EMBODIMENTS

Figure 1:
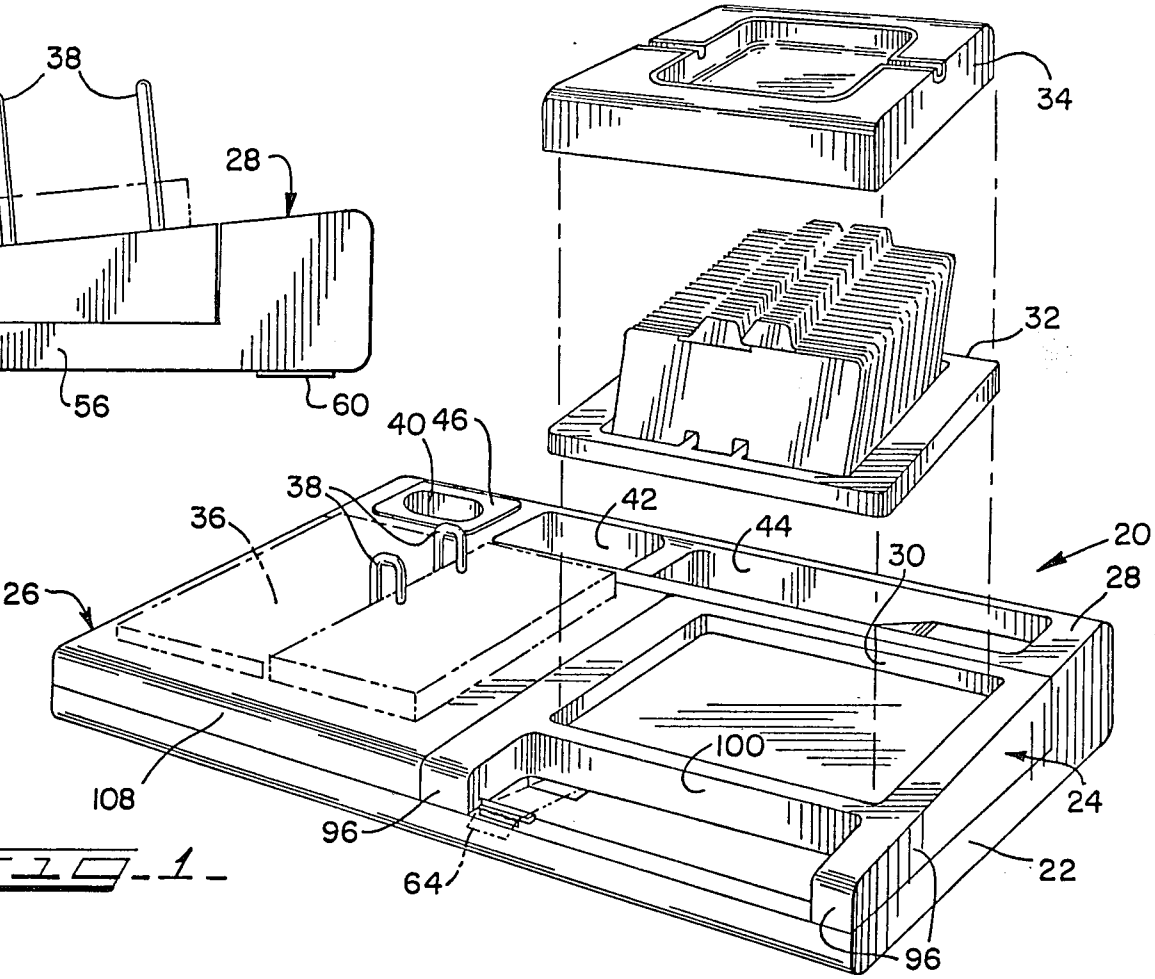
FIG. 1 is an exploded perspective view of a multi-purpose, low-profile desk-top set in accordance with this invention.
Figure 2:
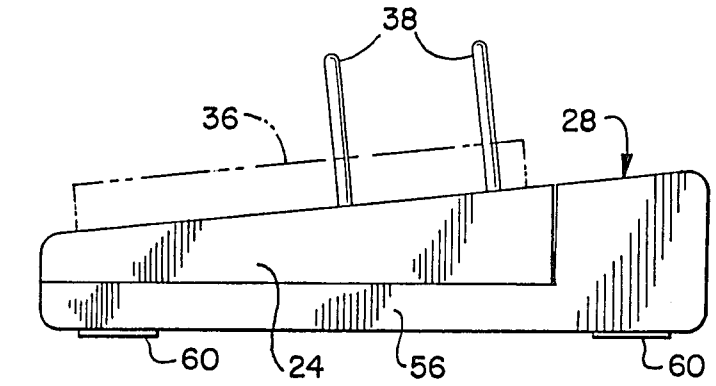
FIG. 2 is a right-side elevational view of this desk set.
Figure 3:
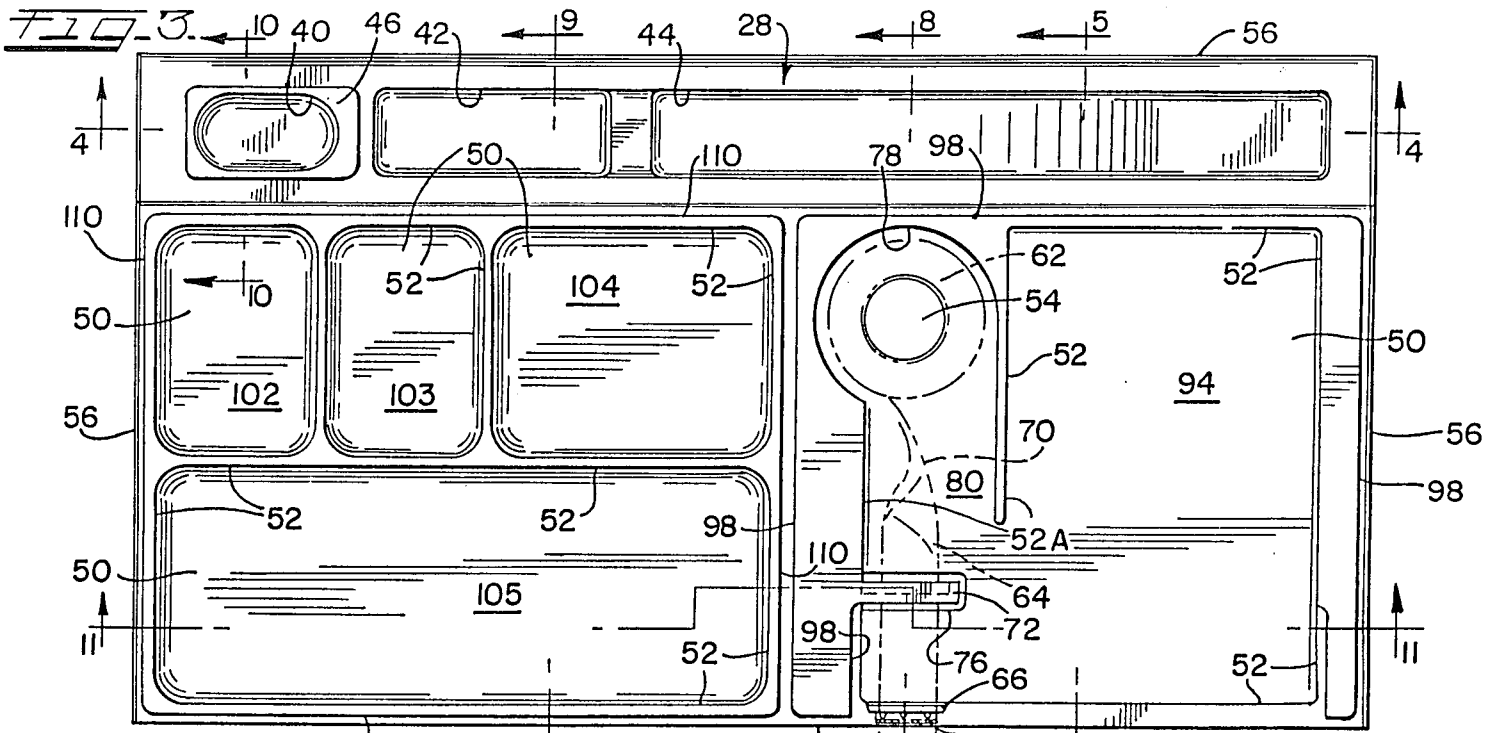
FIG. 3 is a top plan view of this desk set with the upper decks removed therefrom, along with the accessories mounted upon these upper decks.

A multi-purpose desk set 20 in accordance with this invention includes a pedestal structure 22 which is adapted to sit flat upon a horizontal desk top, and a pair of upper deck structures 24 and 26 which sit side-by-side upon the pedestal structure 22. At the rear of the pedestal structure 22, an elevated structure 28 is formed integrally therewith, and rises to the height of the two deck structures 24 and 26. Deck 24 is provided with a recess 30 which can be used in any one of three ways. It can be used to store desk implements or supplies, or it can be used as a receptacle to hold a desk accessory, such as a card file 32 or alternatively an ash tray 34, either one of which fits closely within the recess 30. The deck 26 also serves as a base for a desk accessory, such as a daily calendar 36, the pages of which are bound by upstanding metal rings 38.

Figure 4:
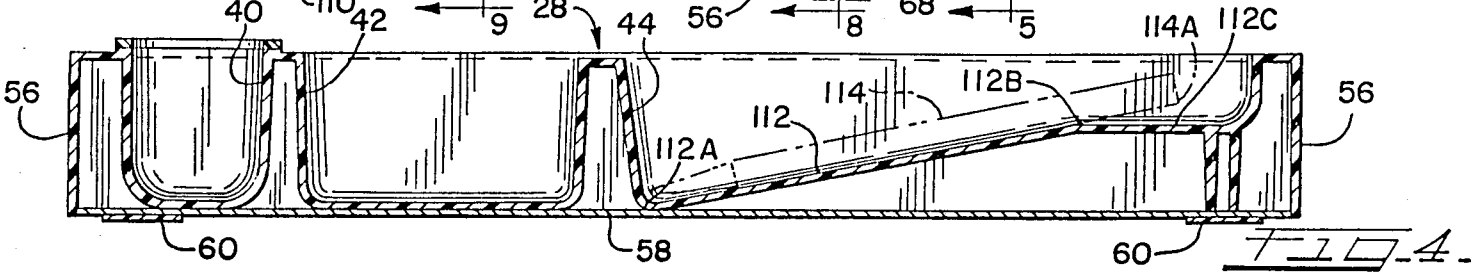
FIG. 4 is a sectional view taken along the lines 4—4 of FIG. 3, looking in the direction of the arrows.
Figures 5, 6, 7, 8, 9, 10:
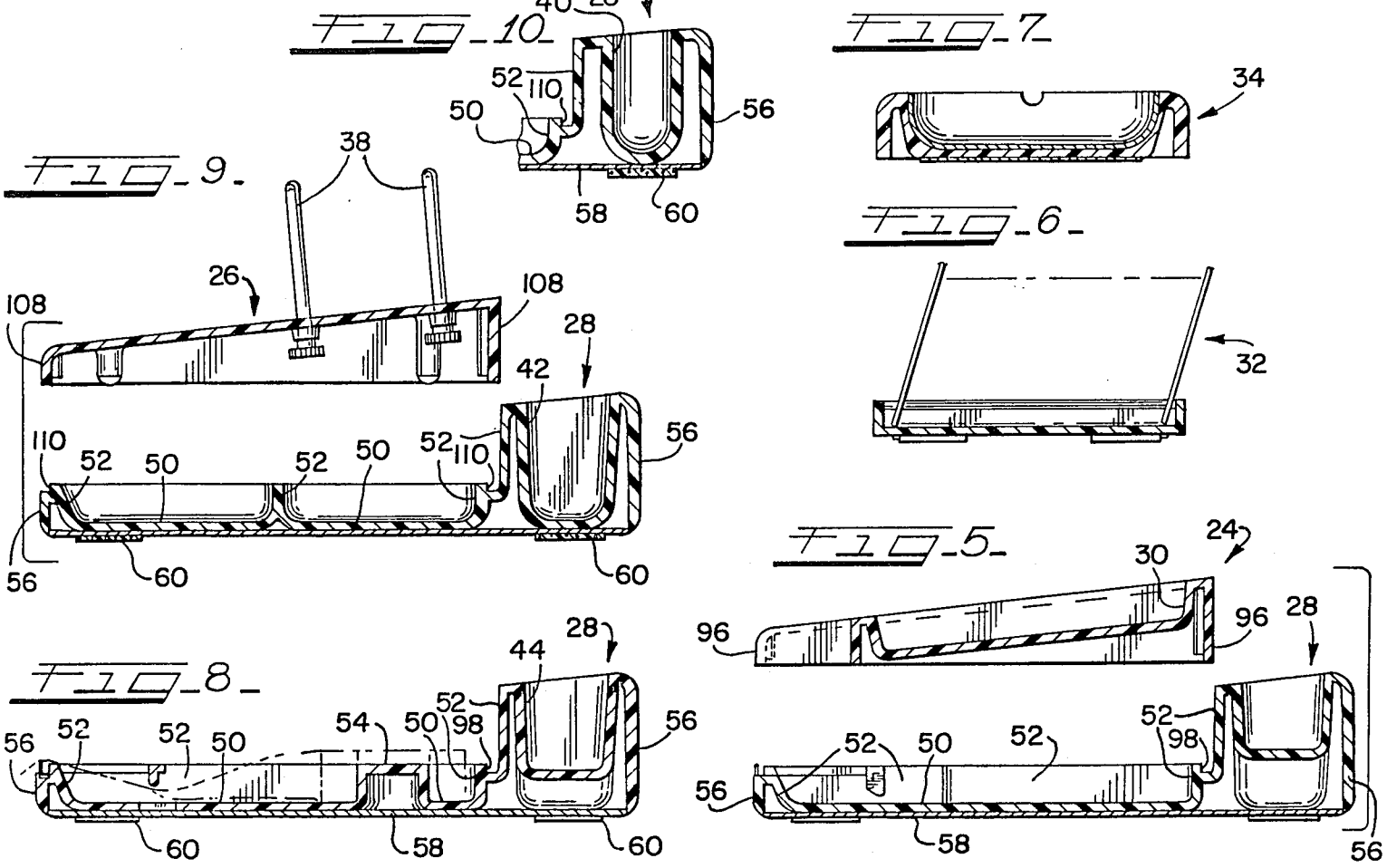
FIG. 5 is a sectional view taken along the lines 5—5 of FIG. 3, looking in the direction of the arrows, and also including one of the upper decks which appears in FIGS. 1 and 2, but not in FIG. 3.
FIG. 6 is a vertical section of the card file accessory seen in FIG. 1.
FIG. 7 is a vertical section of the ash tray accessory seen in FIG. 1.
FIG. 8 is a sectional view, taken along the lines 8—8 of FIG. 3 looking in the direction of the arrows.
FIG. 9 is a sectional view taken along the lines 9—9 of FIG. 3, looking in the direction of the arrows, and including one of the decks which is shown in FIGS. 1 and 2, but not in FIG. 3.
FIG. 10 is a fragmentary sectional view taken along the lines 10—10 of FIG. 3, looking in the direction of the arrows.

The elevated structure 28 has three deep wells 40, 42 and 44 formed therein. The deep well 40 is especially adapted for the storage of paper clips formed of steel wire or some other ferromagnetic material, and has a permanent magnet 46 adhesively secured to the outer wall surface thereof (see FIG. 4) so as to draw paper clips up from the bottom of the well to the top. The well 44 is elongated horizontally, and is especially adapted for the storage of elongated writing utensils such as pens and pencils which are oriented horizontally therein.

The pedestal 22 and elevated structure 28 are preferably integrally molded of a single piece of hard plastic material such as any conventional thermo-setting resin. The pedestal structure, as best seen in the various sectional views of FIGS. 3–11 and 13, is essentially in the form of a flat base sheet 50 which is formed at various places with upstanding structures such as walls 52, a hub 54, and depending outer walls 56. In addition, the elevated structure 28 mentioned previously may be regarded as an upward extension of the walls 52, which terminates in the rear portion of the outer walls 56. A separately molded plastic bottom cover 58 is received at the lower edges of the depending walls 56, and may be secured thereto by any conventional means, such as friction fit, adhesives, ultrasonic welding, or the like. Foot pads 60, formed of a soft felt material, may be adhesively secured to the underside of the bottom cover 58. This type of structure, with the horizontally oriented base sheet 50, and the various walls 52 rising a relatively short distance thereabove, lends itself to a low profile multi-purpose desk set.

The hub 54 is an upwardly projecting circular boss formed in the base sheet 50, which is sized to fit loosely within the inside diameter of a spirally wound roll of tape 62. The axis of the hub 54 is vertical, and so the tape roll 62 is oriented horizontally when mounted upon the hub. This permits the tape roll 62 to be stored flat against the base sheet 50, and thus to provide a low profile for the tape dispenser portion of the desk set 20. A length of tape 64 is pulled radially off the spiral roll 62, and the adhesive side of it is attached to a horizontally oriented, upwardly facing retaining surface 66, best seen in FIGS. 12 and 13. Positioned radially outwardly from the tape-retaining surface 66, relative to the tape roll 62, is a conventional serrated knife edge 68 which is friction-fit within a suitable crevice formed in the body of the pedestal structure 22. As the tape roll 62 sits in a horizontal position upon the hub 54, the free end 64 thereof comes off the roll initially in a vertically oriented position, and must subsequently be twisted 90° at location 70 in order to conform to the horizontal orientation of the tape-retaining surface 66. In order to assist in twisting the tape in this fashion, a bar 72 extends horizontally from one of the walls 52 and across the path of the tape end 64. This bar 72 is formed with a lower surface 74, best seen in FIG. 13, which is horizontally oriented and faces vertically downward. This surface 74 is also rounded so as to engage the non-adhesive side of the tape end 64 in a slidable fashion. Thus, the tape end 64 can be twisted 90°, threaded under the slidably tape-engaging surface 74 of bar 72, and then brought up so that its adhesive side sticks to the tape-retaining surface 66; and in that manner the surface 74 forces the tape end 64 into a horizontal attitude before it reaches the tape retaining surface 66.

In order to facilitate molding of the bar 72, and subsequent withdrawal of the pedestal structure 22 from the mold, an aperture 76 is provided in the base sheet 50 directly below the horizontal tape-twisting surface 74.

In the vicinity of the hub 54 and tape roll 62, the walls 52 rising upwardly from the base sheet 50 form a partial circle the inside diameter of which is somewhat larger than the outside diameter of tape roll 62, thus defining a circular tape storage well 78 surrounding the tape roll 62 and hub 54. Extending forwardly from the tape storage well 78 toward the tape-twisting bar 72 and the tape-retaining surface 66 are portions 52A of the walls 52 which extend parallel to each other to define an exit channel 80 (FIG. 3) for the tape end 64.

Figures 11, 12, 13, 14, 15:
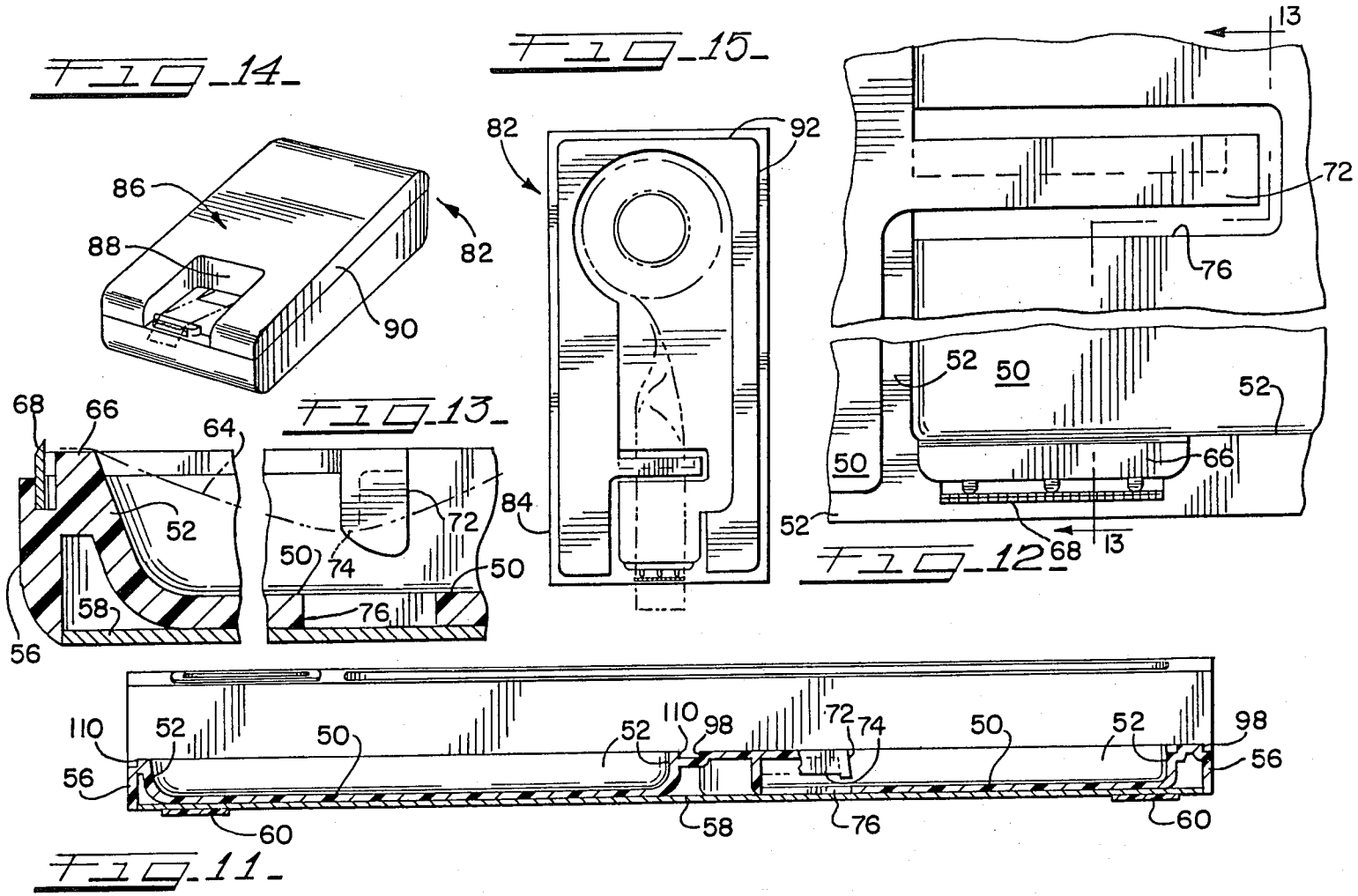
FIG. 11 is a sectional view taken along the lines 11—11 of FIG. 3, looking in the direction of the arrows.
FIG. 12 is an enlarged but fragmentary top plan view of the tape-retaining, tape-cutting, and tape-twisting means of the desk set.
FIG. 13 is a sectional view taken along the lines 13—13 of FIG. 12, looking in the direction of the arrows.
FIG. 14 is a perspective view of a single-purpose tape dispenser device in accordance with this invention.
FIG. 15 is a top plan view of the tape dispenser device of FIG. 14, with the cover removed.

The structure so far described is well suited to a single-purpose low-profile tape dispenser structure. Accordingly, such a tape dispenser 82 is illustrated in FIGS. 14 and 15. This device includes a base portion 84 which contains the tape storage well, the tape exit channel, the tapetwisting bar, the tape-retaining surface, and the cutting edge. It also includes a cover 86 which fits over the base portion 84 to complete the assembly and hide the tape roll and the internal structure of the tape dispenser. The cover 86 is formed with an aperture 88 which defines a tape exit aperture wide enough for the user to slip a finger under the tape end and lift it off the retaining surface so as to withdraw a length of tape from the dispenser. The cover 86 must be removeable from the lower portion 84, in order to reload a fresh roll of tape into the dispenser. Accordingly, the cover has a depending wall 90 which makes a friction-fit about the outside wall of an upstanding boss 92. This fit is tight enough to prevent the cover from being dislodged accidentally, but to permit its removal when the user intends to do so.

In the preferred form of the invention (FIGS. 1–13), however, the tape dispenser structure is combined with other storage facilities at the same horizontal level as the tape dispenser, and preferably also is combined with additional storage facilities at higher levels, the latter being possible primarily because of the unique low profile structure of the tape dispenser itself, resulting from the fact that the tape roll 62 is lying horizontally on its side.

Thus, the walls 52 which are upstanding from the base sheet 50 also enclose a rectangular area 94 of the base sheet 50. This area 94, together with its adjacent portions of walls 52, forms a shallow tray adapted to receive a horizontally oriented stack of unbound sheets of note paper. Thus, the desk set 20 has a low-profile, horizontally oriented tape storage well and dispenser alongside of a low-profile, horizontally oriented well or tray for storing and dispensing note paper.

The upper deck 24 further carries out the multi-purpose design philosophy of this desk set 20, by fitting over the tape storage well 78 and the note paper storage well 94, and providing another level of desk accessory storage facilities above the tape storage and note paper storage wells. The upper deck 24 is formed with depending side walls 96 which surround, and make a friction fit with, a shallow boss 98 integrally formed at the top of that portion of upstanding walls 52 which surrounds the tape storage well 78 and the note paper storage well 94 on three sides thereof. The friction fit between the depending walls 96 of the upper deck 24 and the upstanding boss 98 is tight enough to prevent accidental dislodging of the upper deck 24, but not so tight that it cannot be intentionally removed in order to permit replenishment of the supply of tape in the well 78 and/or the supply of note paper in the well 94.

The upper deck 24, when in place, serves as a cover to hide the interior and contents of these storage wells 78 and 94, and also provides the upper level storage well 30. The latter, as previously noted, can either be used for storage of small desk supplies, or it can be used as a receptacle in which to fit a desk accessory such as the card file 32 or, at another time, the ash tray 34. In order to provide access to the lower level storage wells 78 and 94, the upper deck 24 is formed with a broad indentation 100 which provides an exit aperture for the free end 64 of the tape, and also an exit aperture for withdrawal of sheets of note paper from the storage well 94.

On the opposite side of the low-profile, multi-purpose desk set 20, the upstanding walls 52 branch off in various other directions to form four additional shallow storage wells 102–105 located on various areas of the upper surface of the base sheet 50. Thus, additional storage space for small desk supplies is provided, horizontally displaced from the tape storage well 78 and the note paper storage well 94.

The upper deck 26 serves as a cover to conceal the contents of these storage wells 102–105. The deck 26 is formed with depending outer walls 108 which make a friction fit with an upstanding boss 110 formed on the upper surface of the upstanding walls 52 surrounding the storage wells 102–105 on all four sides thereof. This friction fit, as in the case of the upper deck 24, is tight enough to prevent unintentional dislodging of the upper deck 26, but not so tight as to prevent its intentional removal for access to the storage wells 102–105. In keeping with the multi-purpose design philosophy of this desk set 20, the upper deck 26 not only serves as a cover for the storage wells 102–105, but also serves as a base for the ring-bound calendar 36, for which purpose the metal binding rings 38 are secured to the deck 26.

The low profile concept of this design requires that all the various storage wells 78, 94 and 102–105 on the lower level, as well as storage area 30 on the upper deck 24, be of relatively shallow depth. In order to meet a demand for additional storage space of somewhat greater depth, but without increasing the overall height of the desk set 20, the elevated structure 28 is provided. This structure rises barely above the height of the upper decks 24 and 26, when the latter are in place over the storage wells 78, 94 and 102–105. Thus, the overall height of the desk accessory is not greatly increased by this elevated structure 28. Nevertheless, the elevated structure permits deep storage wells 40, 42 and 44 to be provided, which are as deep as the lower level storage areas 78, 94 and 102–105 plus the upper level storage area 30, all combined. As noted previously, the deep storage well 40 is able to hold a considerable volume of paper clips owing to its depth, yet, because of the rubber permanent magnet material 46, it keeps some of these paper clips near the upper level of the well for ready availability.

The deep storage well 42 is for general storage purposes, and is somewhat broader than well 40 in order to provide easier finger access to the depth of the well.

Finally, the pen and pencil well 44 provides a unique horizontally oriented storage space for these writing implements, which provides a much lower profile, and hence a more pleasing esthetic appearance, as compared to the conventional upright cup type of storage device commonly used for pens and pencils. As a result, elongated writing instruments of this kind can be stored flat and unobtrusively within the deep well 44.

The upright cup type of pen and pencil storage device does, however, have one great advantage, and that is that one end of the pen or pencil is always raised upwardly for ease of retrieval from the cup. In order to achieve a similar advantage in the environment of a horizontally oriented storage well for pens and pencils, such as the deep well 44, the floor 112 of this well is provided with an upwardly facing convex shape. Thus, from its deepest point 112A, the floor slants upwardly until it reaches a highest point or apex 112B. Continuing on beyond that point, the floor has a portion 112C which is essentially horizontal. If desired it could even slant downwardly below the level of the apex point 112B, but the important factor is that portion 112C does not rise higher than point 112B. As a result, a pen or pencil 114 which is placed horizontally within the well 44, provided it is longer than the distance from the bottom 112A to the apex 112B, will have one end 114A thereof which rises at an angle above the remaining portion 112C of the floor of the well. This permits the user easily to slip a finger underneath end 114A of the pen or pencil, i.e. between end 114A and floor portion 112C, and thereby grasp the pen or pencil 114 to retrieve it from the well 44. Since it obviously would be desirable for the user to know in advance which end of the pen or pencil 114 is going to be in this upraised attitude, it is desirable that the apex 112B be substantially to one side of the longitudinal midpoint of the elongated well 44. If that were not true, then the pen 114 might teeter unpredictably clockwise or counterclockwise about the apex 112B, thus raising the possibility that the wrong end of the pen or pencil might be upraised.

It will by now be clearly appreciated that the present invention not only provides a low profile desk accessory useful for a single purpose, such as the dispensing of adhesive tape, but also, in the preferred multi-purpose embodiment thereof, provides a desk set for combining a wide variety of storage facilities within a single implement, while still retaining the low profile aspect. This permits visual improvement in the office environment, not only by providing the designer of desk accessories with greater opportunities to exploit the low profile look, but also by eliminating clutter through the combination of various separate storage facilities into a single integrated structure.

While the embodiments shown and described herein are preferred, there may be other specific structures which can achieve some or all of the novel features of this invention. For that reason, the embodiments shown and described herein are to be considered merely exemplary, and the scope of protection afforded this invention should be at least as broad as that set out in the appended claims.

We claim:

1. Low-profile desk top apparatus comprising:

substantially planar base means adapted to sit in a substantially horizontal attitude upon a horizontal desk top, with one surface of said base means facing upwardly;

wall means upstanding from said upper surface of said base means and surrounding at least a portion of said upper surface to define at least one storage well thereon;

said wall means terminating in an upper surface having boss means upstanding therefrom which at least partially surround said storage well;

upper deck means adapted to cover over said storage well and having means depending therefrom adapted to make a frictional with said boss means for securing said upper deck means in place over said storage well;

elevated structure on said base means, horizontally displaced from said storage well, and rising to substantially the height of said upper deck means when the latter is in place over said wall means;

at least one deep well in said elevated structure adapted for storage of desk implements;

a portion of said wall means extends away from said storage well and at least partly encircles a second portion of said upper surface of said base means which is not occupied by said storage well, to define at least a second storage well on said upper surface of said base means which is horizontally displaced from said first storage well;

a plurality of upper deck means adapted to fit removeably over said base means in side-by-side relation to each other, and collectively to cover over both of said storage wells; and one of said upper deck means has respective upper surface adapted for mounting at least two different types of desk accessories atop said upper deck means.

2. Apparatus as in claim 1 wherein at least one of said upper deck means has an upper surface which has an upwardly facing storage recess.

3. Apparatus as in claim 1 wherein at least one of said storage well is substantially rectangularly shaped, and sized to receive a stack of unbound writing paper sheets oriented horizontally, and said corresponding upper deck means has exit aperture means extending over an edge of said paper storage well, said exit aperture means being adapted to permit finger access to an edge of said paper stack whereby a sheet of paper may be withdrawn from said stack.

4. Apparatus as in claim 3 wherein said upper deck means has an upper surface with an upwardly facing storage recess.

5. Apparatus as in claim 1 wherein said upper deck means are adapted to cover over both of said storage wells.

6. Apparatus as in claim 1 wherein at least two of said upper deck means having respective means on their respective upper surfaces for mounting at least two different types of desk accessories atop said upper deck means.

7. Apparatus as in claim 6 wherein one of said upper deck means has means on its upper surface for mounting a desk calendar thereon.

8. Apparatus as in claim 7 wherein another of said upper deck means has an upwardly facing receiving well on its upper surface adapted to serve at different times as both a storage bin and as a receptacle for a desk accessory.

9. Apparatus as in claim 8 further comprising means including an ash tray adapted to fit closely but removeably within said receiving well.

10. Apparatus as in claim 8 further comprising means including a card file adapted to fit closely but removeably within said receiving well.

11. Apparatus as in claim 8 further comprising a plurality of different types of desk accessories, each adapted to fit closely but removeably within said receiving well at different times.

12. Apparatus as in claim 1 wherein at least part of said deep well extends from the top of said elevated structure down to substantially the level of said base means whereby to provide deeper storage space than said storage wall.

13. Apparatus as in claim 12 wherein said deep well is sized to accommodate ferromagnetic paper clips, and further comprising permanent magnet means secured adjacent the top of said deep well whereby to retain at least some of said paper clips at an upper level of said deep well.

14. Apparatus as in claim 12 wherein said deep well is horizontally elongated to accommodate one or more horizontally oriented elongated writing utensils.

15. Apparatus as in claim 12 wherein said deep well has upwardly convex means on the floor thereof whereby one end of an elongated writing utensil which is stored in a horizontal orientation in said deep well will project above said floor for ease of retrieval of said writing utensil from said deep well.

16. Apparatus as in claim 15 wherein the apex of said convex means is located at one side of the longitudinal mid-point of said elongated deep well whereby to determine which end of said writing utensil will project above said deep well floor.

* * * * *